US008786187B2

(12) United States Patent
Buttstaedt et al.

(10) Patent No.: US 8,786,187 B2
(45) Date of Patent: Jul. 22, 2014

(54) DISCHARGE LAMP WITH AN OUTER BULB SURROUNDED BY A WIRE GAUZE AS EXPLOSION PROTECTION

(75) Inventors: Johannes Buttstaedt, Falkensee (DE); Stefan Dunkel, Berlin (DE); Andreas Genz, Berlin (DE); Maik Hegewald, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/885,408

(22) PCT Filed: Nov. 7, 2011

(86) PCT No.: PCT/EP2011/069506

§ 371 (c)(1),
(2), (4) Date: Jul. 4, 2013

(87) PCT Pub. No.: WO2012/065870

PCT Pub. Date: May 24, 2012

(65) Prior Publication Data

US 2013/0285543 A1 Oct. 31, 2013

(30) Foreign Application Priority Data

Nov. 17, 2010 (DE) ..... 10 2010 044 045

(51) Int. Cl.
*H01J 17/16* (2012.01)

(52) U.S. Cl.
CPC ..... *H01J 17/16* (2013.01)
USPC ..... 313/635; 313/634

(58) Field of Classification Search
CPC ..... H01J 17/16
USPC ..... 313/634, 635
See application file for complete search history.

(56) References Cited

U.S. PATENT DOCUMENTS

| | | | | |
|---|---|---|---|---|
| 4,721,876 | A * | 1/1988 | White et al. | 313/25 |
| 4,888,517 | A * | 12/1989 | Keeffe et al. | 313/25 |
| 5,576,591 | A | 11/1996 | Block et al. | |
| 7,511,431 | B2 | 3/2009 | Lesch et al. | |

FOREIGN PATENT DOCUMENTS

| | | | |
|---|---|---|---|
| DE | 4317252 | C1 | 5/1994 |
| EP | 0104594 | A2 | 4/1984 |
| EP | 0306269 | A2 | 3/1989 |
| JP | H0594806 | A | 4/1993 |
| JP | 2007329052 | A | 12/2007 |
| JP | 2009206056 | A | 9/2009 |

OTHER PUBLICATIONS

English abstract of JP2007329052A; Dec. 20, 2007.
English abstract of JP2009206056A; Sep. 10, 2009.
English abstract of JPH0594806A; Apr. 16, 1993.

* cited by examiner

*Primary Examiner* — Mary Ellen Bowman

(57) ABSTRACT

A bushing for a high-pressure discharge lamp, which is suitable for connecting an electrode in the interior of a ceramic discharge vessel to a supply lead in a gastight manner on the exterior of the discharge vessel, wherein the bushing is an electrically conductive ceramic composite consisting of a mixture of $LaB_6$ and at least one second material from the group $Al_2O_3$, $Dy_2Al_5O_{12}$, AlN, AlON and $Dy_2O_3$ is disclosed.

10 Claims, 4 Drawing Sheets

DISCHARGE LAMP WITH AN OUTER BULB SURROUNDED BY A WIRE GAUZE AS EXPLOSION PROTECTION

RELATED APPLICATIONS

The present application is a national stage entry according to 35 U.S.C. §371 of PCT application No.: PCT/EP2011/069506 filed on Nov. 7, 2011, which claims priority from German application No.: 102010044045.0 filed on Nov. 17, 2010.

TECHNICAL FIELD

Various embodiments relate to a discharge lamp. In particular, metal halide lamps with outer bulbs are involved in this case.

BACKGROUND

DE 43 17 252 and EP 306 269 disclose a lamp in which the discharge vessel is protected against explosions by a wire braiding or wire gauze. However, such wire gauzes are problematic owing to the risk of escape of sodium and the high production costs owing to the complex assembly.

SUMMARY

Various embodiments provide a lamp which enables reliable explosion protection in conjunction with low additional costs. Various embodiments are, in the case of an Na-containing filling, to prevent an escape of Na as much as possible.

The lamp according to the invention is suitable for operation in open luminaries since it has a wire gauze as reliable explosion protection.

The explosion protection presented is suitable for high-pressure discharge lamps, in particular having a metal halide filling. Customary wattages are 50 to 400 W. The explosion protection is suitable for all fillings, but affords particular advantages in the case of Na-containing fillings. Sodium is usually introduced in the form of NaJ. If this compound decomposes in the discharge arc, the Na ion can penetrate through the hot quartz wall if a corresponding electric field is present. This mechanism is prevented by the wire gauze.

The discharge vessel can be closed on one side or preferably on two sides. It is produced from quartz glass or ceramic such as $Al_2O_3$.

The luminous means in the interior of the discharge vessel is a discharge arc between two electrodes. It is electrically conductively connected to bushings leading to it.

The invention proposes a construction in which the discharge vessel is enclosed by an outer bulb. In particular, it is fixedly fused with the latter. A wire gauze is applied on a central cylindrical part of the outer bulb, said wire gauze being embodied such that it bears fixedly on the outer bulb without further holding elements and does not slip. This construction is situated in particular with a frame in an enveloping bulb which carries the base and the power supply lines. The wire gauze is characterized by the wire diameter D, the mesh width B and the mesh length L. In particular, the following conditions hold true:

The ratio L/D is preferably between 25 and 60. The following furthermore holds true: the ratio NF/P between the gauze area NF in $mm^2$ covered by the wire gauze and the lamp power P in W is preferably between 10 and 35. The ratio Z/L of the length of the cylindrical part Z of the outer bulb to L is preferably between 3 and 12. The ratio U/B of the circumference U of the cylindrical part of the outer bulb to B is preferably between 5 and 20. This not only achieves optimum explosion protection, but at the same time also minimizes shading by the wire gauze.

Overall, this ensures that explosion protection is guaranteed with production costs that are as low as possible and with as little loss of luminous flux as possible in comparison with a lamp without explosion protection.

In one particularly advantageous embodiment, the outer bulb tapers at the ends of its cylindrical part. It is then possible to apply the wire gauze to the outer bulb without any mount.

Advantageously, for this purpose, the wire gauze has a reduced mesh width at its two ends in comparison with its central point (as seen in the axial direction). As a result, at the ends so-called cuffs arise, that is a kind of gathering, such that the wire gauze adheres well on the outer bulb. The cuffs interact in particular with the tapering end to form a particularly reliable mount.

Since holding elements can be dispensed with as a result, the well-known risk of an escape of sodium from the discharge vessel is decisively reduced.

The self-retention of the gauze significantly reduces the production costs for fitting the gauze.

The alignment of the meshes is usually axially parallel, but this is not absolutely necessary. Instead of rectangular meshes, for example diamond-shaped meshes can also be used. In such cases, L is taken to mean the largest longitudinal dimension of a mesh, as seen axially parallel, and B is taken to mean the largest dimension of a mesh transversely with respect to the longitudinal axis.

A high-pressure discharge lamp includes a discharge vessel sealed in vacuum-tight fashion, said discharge vessel defining a longitudinal axis (A), containing an ionizable filling and two electrodes and being enclosed by an outer bulb, wherein the outer bulb has a cylindrical central part, wherein at least the cylindrical central part is closely surrounded by a wire gauze as explosion protection, wherein the wire gauze is characterized by the wire diameter D and the mesh length L of the gauze, and wherein the ratio L/D is in the range of 25 to 60, boundary values inclusive.

In a still further embodiment, the lamp is configured such that in the region of the central part the ratio between the regular gauze area NF in $mm^2$ and the lamp power P is between 10 and 35, boundary values inclusive.

In a still further embodiment, the ratio between the length Z of the cylindrical central part and the value L is in the range of 3 to 12, boundary values inclusive.

In a still further embodiment, the ratio between the circumference U of the cylindrical central part and the mesh width B of the gauze is between 5 and 20, boundary values inclusive.

In a still further embodiment, the discharge vessel contains metal halides, in particular includes sodium as metal of the halide.

In a still further embodiment, the wire gauze has at least one end region in which the length of the meshes LR is reduced relative to the main region, and is preferably reduced by at least 30%, particularly preferably reduced by at least 50%, relative to the main region.

In a further embodiment, the outer bulb is produced from quartz glass.

In a still further embodiment, the wire gauze bears directly on the outer bulb or a part thereof.

In a still further embodiment, the outer bulb has at least one end which tapers relative to the central part.

In a still further embodiment, the wire gauze is applied in a double-layered fashion at least in sections.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the invention. In the following description, various embodiments of the invention are described with reference to the following drawings, in which.

DETAILED DESCRIPTION

Figure 1:
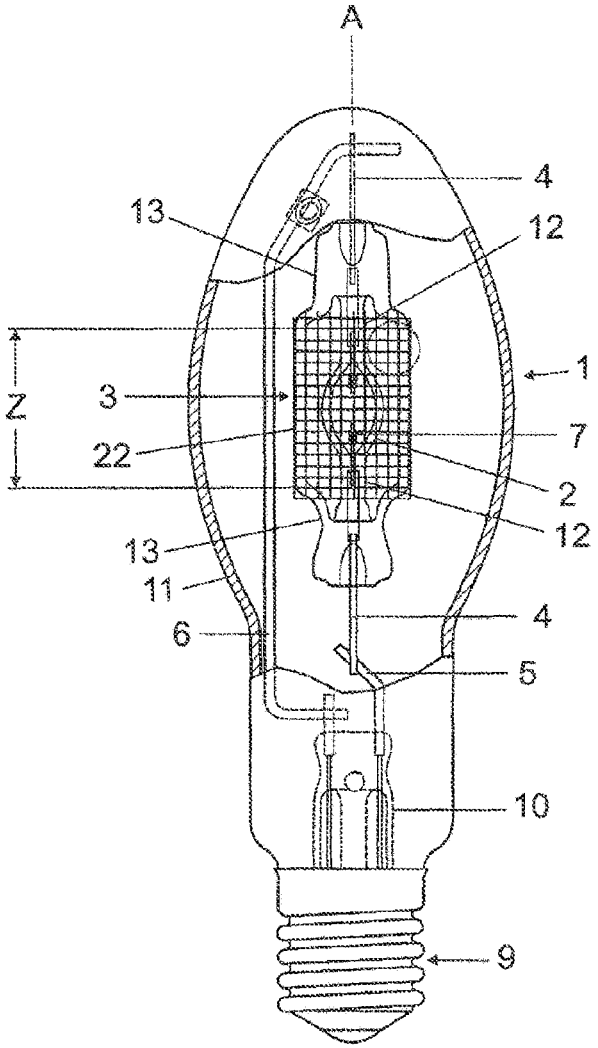
FIG. 1 shows an embodiment of a metal halide lamp in side view.

FIG. 1 shows the construction of a high-pressure discharge lamp 1 highly schematically. Said lamp has a discharge vessel 2 having two ends 12, said discharge vessel being accommodated in an outer bulb 3, which likewise has two ends 13, such that the outer bulb defines a longitudinal axis A. Both bulbs are composed of quartz glass, but the discharge vessel can also be produced from ceramics such as $Al_2O_3$. The outer supply lines 4 of the discharge vessel, which make contact with electrodes 7 in the interior, are extended through the tapering ends 13 of the outer bulb and connected to two frame wires 5 and 6 outside. A short frame wire 5 leads to a first feed line of the base 9. A long frame wire 6, often called bow wire, leads to a second feed line of the base. Both feed lines are fixed in a plate-like stand 10 seated in an enveloping bulb 11. A wire gauze 22 extends here onto the cylindrical central part of the outer bulb 3 and is uniformly structured.

Figure 1A:
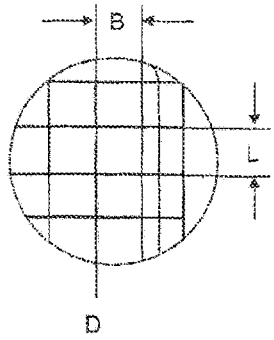

The detail in FIG. 1A shows the diameter D of the wire, this usually being high-temperature-resistant high-grade steel wire, the length L of the individual mesh and the width B of the individual mesh. Over the entire wire gauze, these parameters are constant in this embodiment.

In specific wire gauzes, the following dimensioning rules are complied with:

L/D is between 25 and 60. The following furthermore holds true: the ratio of the gauze area in $mm^2$ to the lamp power in W is between 10 and 35. The ratio of the length LK of the cylindrical part of the outer bulb to L is between LK/L=3 and LK/L=12. The ratio of the circumference U of the cylindrical part of the outer bulb to B is between U/B=5 and U/B=20.

Specific embodiments are as follows:

Embodiment 150 W lamp:
Outer bulb length AKL=50 mm,
Outer bulb diameter 22 mm,
D=0.11 mm; L=6 mm;
Outer bulb length to L: ALK/L=8.3
Circumference to B: U/B=17.2
Gauze area in $mm^2$ to power P in W: NF/P=23
L/D=54.5
Loss of luminous flux as a result of explosion protection 4%.

Embodiment 70 W:
Outer bulb length AKL=32 mm,
Outer bulb diameter 19 mm,
D=0.11 mm; L=6 mm;
Outer bulb length to L: ALK/L=5.3
Circumference to B: U/B=14.9
Gauze area in $mm^2$ to power P in W: NF/P=25.4
L/D=54.5
Loss of luminous flux as a result of explosion protection 6%.

Figure 2:
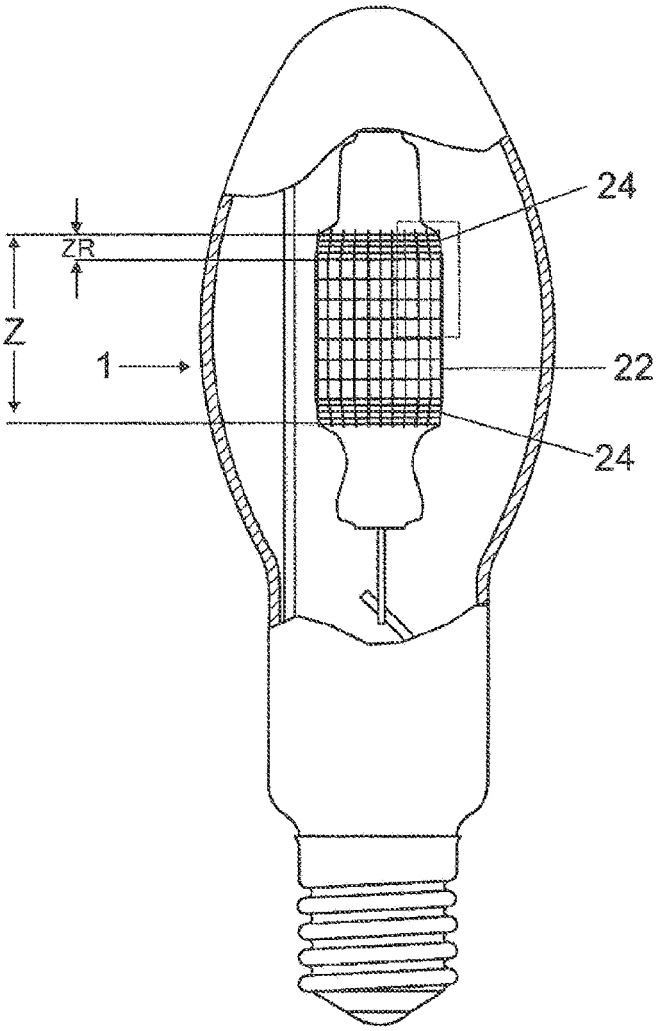
FIGS. 2-4 show further embodiments of a metal halide lamp in side view.
Figure 2A:
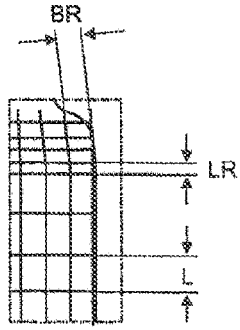
Figure 3:
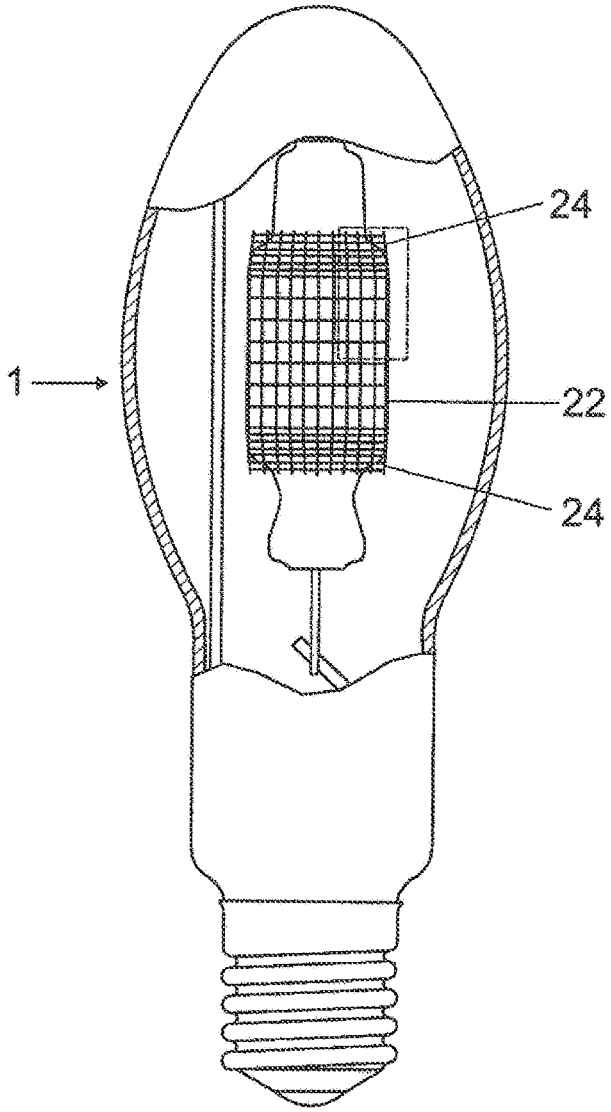
Figure 3A:
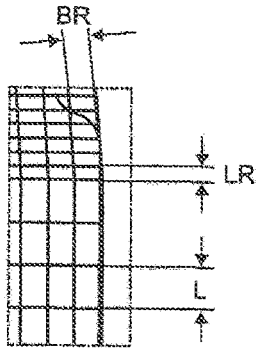

The following generally holds true in accordance with FIG. 2: the wire gauze 22 has an edge region 24 having the axial length ZR, which edge region makes up a length of typically 5% to 15% of the total length Z of the cylindrical part of the outer bulb at each end. Said edge region serves for the better fixing of the wire gauze without further holding or clamping elements. Said edge region 24 can terminate with the cylindrical part of the outer bulb, in particular, in accordance with FIG. 2. In accordance with FIG. 3, it can project slightly. In a further embodiment in accordance with FIG. 4, at least the edge region 24 or else the entire wire gauze can be wrapped around once, see FIG. 4A, where the two wires are slightly displaced relative to one another, designated by X1 and X2.

In said edge region, the mesh length LR is reduced relative to L in all three exemplary embodiments. L:LR=1.5 to 5 preferably holds true. The mesh width BR can, but need not, be reduced at the edge relative to B; it holds true that B:BR=1 to 2.

Figure 4:
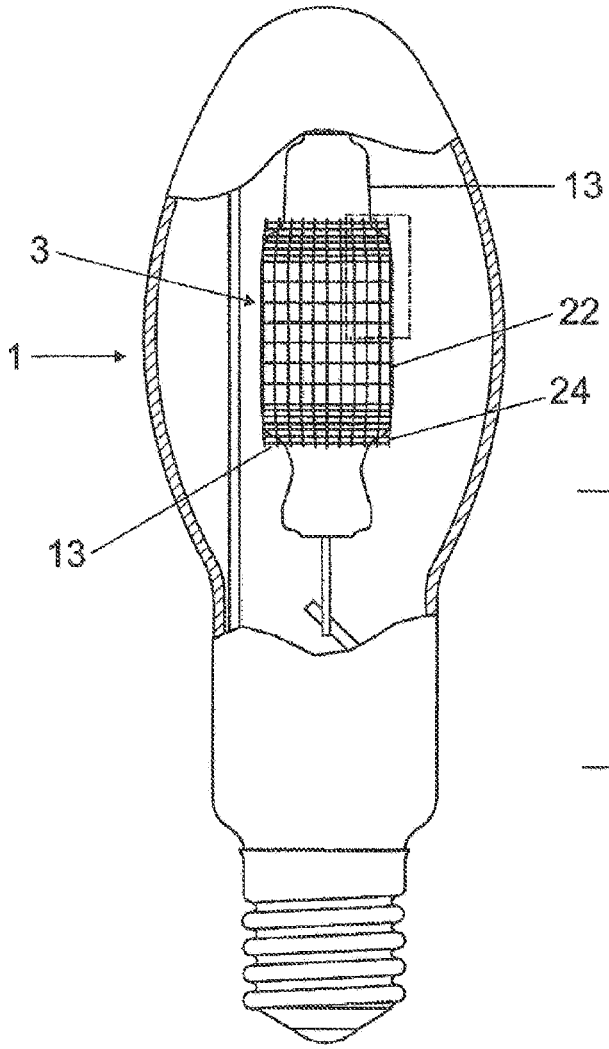
Figure 4A:
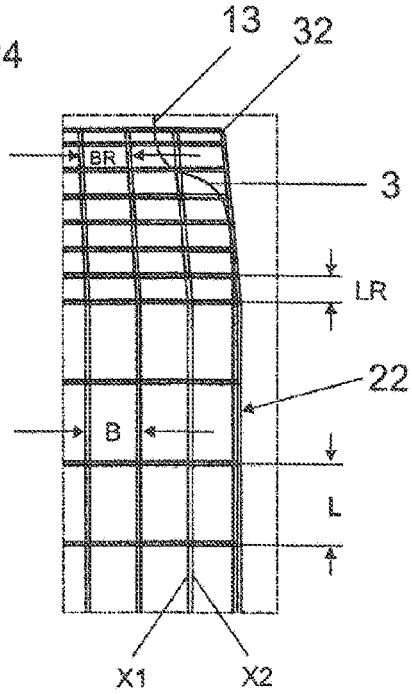

FIG. 4 shows a particularly preferred exemplary embodiment of a high-pressure discharge lamp 1 having metal halide filling containing halides of Na as filling. In this case, it is very advantageous that the outer bulb 3 has tapering ends 13. The wire gauze 22 is lengthened to an extent such that it also extends onto a part of the end 13 of the outer bulb. In the end region 32 of the wire gauze, however, the gauze is narrowed, such that it throws cuffs. In this case, the mesh length LR is significantly reduced relative to the value L for the central part of the outer bulb. Typically, the value for L is reduced to at most 50% of the value in the central part 22; a value of 0.2 L to 0.45 L is preferred for LR. In the event of this specification being complied with, the cuffs provide for a pronounced self-retaining effect in the region of the tapering ends 13 of the outer bulb.

In principle, such a wire gauze can also be employed in other lamps. The wire gauze can, if appropriate, also have cuffs only at one end region. This preferably holds true for an end region situated in a top position under operating conditions.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high pressure discharge lamp comprising a discharge vessel sealed in vacuum-tight fashion, said discharge vessel defining a longitudinal axis, containing an ionizable filling and two electrodes and being enclosed by an outer bulb, wherein the outer bulb has a cylindrical central part, wherein at least the cylindrical central part is closely surrounded by a wire gauze as explosion protection, wherein the wire gauze is characterized by the wire diameter and the mesh length of the gauze, and wherein the ratio of mesh length to wire diameter is in the range of 25 to 60, boundary values inclusive, wherein the outer bulb further comprising a plurality of ends tapering relative to the central part, and wherein end regions of the wire gauze each have a reduced mesh width so that the wire gauze adheres to the outer bulb without any mount.

2. The lamp as claimed in claim 1, wherein in the region of the central part the ratio between the regular gauze area in square millimeters to the lamp power in watts is between 10 and 35, boundary values inclusive.

3. The lamp as claimed in claim 1, wherein the ratio between the length of the cylindrical central part and the mesh length is in the range of 3 to 12, boundary values inclusive.

4. The lamp as claimed in claim 1, wherein the ratio between the circumference of the cylindrical central part and the mesh width of the gauze is between 5 and 20, boundary values inclusive.

5. The lamp as claimed in claim 1, wherein the discharge vessel contains metal halides.

6. The lamp as claimed in claim 1, wherein the wire gauze has at least one end region in which the length of the meshes is reduced relative to the main region by at least 30%.

7. The lamp as claimed in claim 1, wherein the outer bulb is produced from quartz glass.

8. The lamp as claimed in claim 1, wherein the wire gauze bears directly on the outer bulb or a part thereof.

9. The lamp as claimed in claim 1, wherein the wire gauze is applied in a double layered fashion at least in sections.

10. The lamp as claimed in claim 1, wherein the discharge vessel comprises sodium as metal of the halide.

* * * * *